US005753277A

United States Patent [19]

Kikutani et al.

[11] Patent Number: 5,753,277

[45] Date of Patent: May 19, 1998

[54] SPINNERET FOR MANUFACTURING MODIFIED CROSS-SECTION FIBERS WITH OPTICAL FUNCTION

[75] Inventors: Takeshi Kikutani, Tokyo; Katsumi Morohoshi, Yokosuka; Susumu Shimizu, Hadano; Akio Sakihara, Isehara; Hiroshi Tabata, Yokohama; Kinya Kumazawa, Yokosuka, all of Japan

[73] Assignees: Nissan Motor Co., Ltd., Yokohama; Tanaka Kikinzoku Kyogo K.K., Tokyo, both of Japan

[21] Appl. No.: 601,977

[22] Filed: Feb. 15, 1996

[30] Foreign Application Priority Data

Feb. 16, 1995 [JP] Japan ..... 7-028520

[51] Int. Cl.[6] ..... D01D 5/30

[52] U.S. Cl. ..... 425/461; 425/382.2; 264/171.1; 264/172.13

[58] Field of Search ..... 425/131.5, 461, 425/382.2; 264/171, 171.1, 172.13, 172.15

[56] References Cited

U.S. PATENT DOCUMENTS

| | | | |
|---|---|---|---|
| 3,156,607 | 11/1964 | Strachan | 264/177.13 |
| 3,249,669 | 5/1966 | Jamieson | 264/177.13 |
| 3,546,328 | 12/1970 | Lodge et al. | 425/131.5 |
| 3,551,279 | 12/1970 | Ando et al. . | |
| 3,801,249 | 4/1974 | Milani | 425/461 |
| 4,457,685 | 7/1984 | Huang et al. | 425/461 |
| 4,687,610 | 8/1987 | Vassilatos . | |
| 5,407,738 | 4/1995 | Tabata et al. . | |

FOREIGN PATENT DOCUMENTS

| | | | |
|---|---|---|---|
| 943314 | 3/1974 | Canada | 425/131.5 |
| 0 207 705 | 1/1987 | European Pat. Off. . | |
| 0 265 074 | 4/1988 | European Pat. Off. . | |
| 0 399 397 | 11/1990 | European Pat. Off. . | |
| 1 785 209 | 5/1972 | Germany . | |
| 44-13208 | 6/1969 | Japan . | |
| 46-3816 | 1/1971 | Japan . | |
| 47-14763-R | 5/1972 | Japan | 425/131.5 |
| 47-33008-R | 8/1972 | Japan | 425/131.5 |
| 48-28361-R | 8/1973 | Japan | 425/131.5 |
| 62-25766 | 6/1987 | Japan . | |
| 5-25705 | 2/1993 | Japan . | |
| 6-17349 | 1/1994 | Japan . | |
| 2 057 344 | 4/1981 | United Kingdom . | |

OTHER PUBLICATIONS

Hansen, H., "Verschiedenartiger Glanz von Textilien durch Einsatz von Chemiefasern," *Chemiefasern*, Dec. 1968, pp. 926–928.

Patents Abstracts of Japan, JP 62–97909, C–451, vol. 11, No. 31, Oct. 14, 1987.

*Primary Examiner*—Jay H. Woo
*Assistant Examiner*—Minh-Chau T. Pham
*Attorney, Agent, or Firm*—Foley & Lardner

[57] ABSTRACT

A spinneret for manufacturing modified cross-section fibers with optical function includes tubes arranged to a spinneret for spinning an island portion, and a partition device for enclosing the tubes for leading a melt polymer. The spinneret and the partition device cooperating with each other to define a predetermined space.

17 Claims, 7 Drawing Sheets

FIG.6A
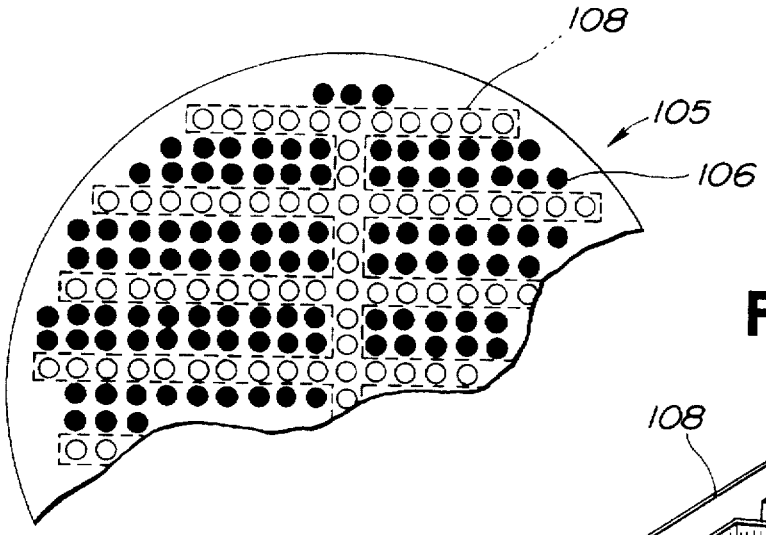
FIG.6B
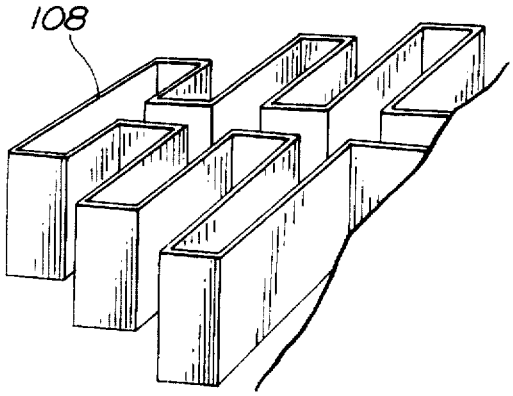
FIG.7A
FIG.7B
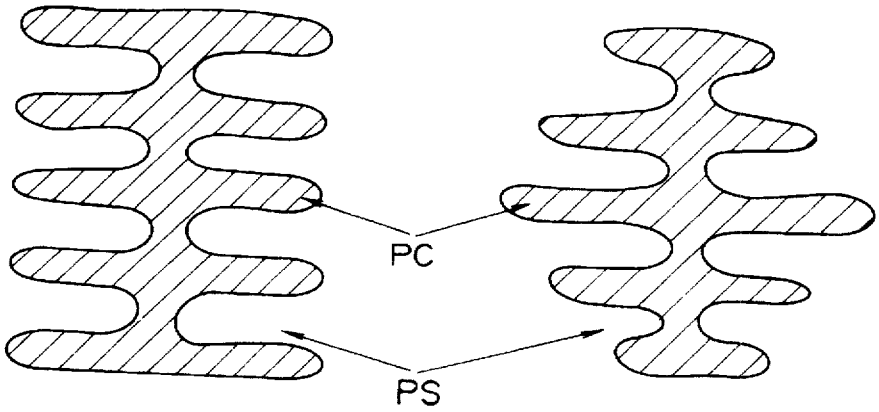

SPINNERET FOR MANUFACTURING MODIFIED CROSS-SECTION FIBERS WITH OPTICAL FUNCTION

BACKGROUND OF THE INVENTION

The present invention relates generally to a spinneret for manufacturing fibers with new optical function and more particularly, to a spinneret for manufacturing modified cross-section fibers with optical function, which serves, in particular, to spin island portions which constitute together with a sea portion an islands-in-a-sea type fiber with optical function for reflecting ultraviolet (UV) or infrared (IR) ray or showing colors by reflection, interference, diffraction or scattering phenomena of visible light ray.

Recently, in compliance with a demand for high fabric quality, many sensory fibers are manufactured which have not a simple round cross section, but a modified cross section to obtain improved properties such as luster and texture. Generally, in view of difficulty of being obtained from a single component, such fibers are made of melt spinning which comprises two or more polymeric components, using as a spinneret a nozzle with an opening in modified shape. Moreover, various improvements are performed in the shape of the modified nozzle, the design of passages up to the modified nozzle and extrusion openings, etc.

JP 44-13208 discloses a polymer arrayal or fiber spinning equipment wherein a composite spinning for forming a composite flow is obtained by extruding one component from tubes for leading a melt polymer, which corresponds to island portions, and the other component from middle spinneret through porous portions thereof, arranged around the tubes and using a porous material, which corresponds to a sea portion. This is featured by the use of the porous material for the spinneret for extruding the other component. Moreover, formed fibers have a cross section wherein the island portions of the one component are dispersed in the sea portion of the other component, having expected improvement not only in the fiber characteristic such as luster and texture, but in the mechanical properties.

JP 46-3816 and JP-B2 62-25766 disclose a manufacturing of islands-in-a-sea type multicomponent fibers having a modified cross section. In the former document, tubes of a spinneret which serve to form island portions have an opening in the middle thereof, into which flows a part of polymer for forming a sea portion, obtaining an islands-in-a-sea cross section with two components arranged in layer. On the other hand, the latter document is featured, particularly, by the shape of a cross section of island portions which is in a wedge, cross, etc. Moreover, for preventing a lowering of fluid pressure of the other component flowing between the tubes and a reduction in extrusion irregularity thereof, this document recommends less number of tubes.

JP-A 5-25705 discloses a spinneret for obtaining a laminated structure arranged symmetrically in the longitudinal direction of fibers by removing a confluence and collision of mulled composite flows. As for the number of openings of a spinneret and the arrangement thereof, this document recommends a disc spinneret having approximately 300–2, 500 openings arranged concentrically.

The above spinnerets provide composite fibers with a modified cross section improved in the fiber characteristic such as luster and texture and the mechanical properties, but cannot form fibers with a complicated modified cross section having an optical dimension for presenting the optical function.

Examples of the known spinneret will be described briefly. In a spinneret of the dispersed island type, a melt polymer for forming island portions passes through tubes held by upper and middle spinnerets. At the same time, a melt polymer for forming a sea portion passes through a passage arranged in the upper spinneret, and it is accumulated in a space between the upper and middle spinnerets. The middle spinneret is made of a porous material, so that the melt polymer for forming a sea portion is uniformly extruded, together with the melt polymer for forming island portions, to a funnel-shaped spinneret so as to come to a discharge opening. The modified shape of island portions is obtained by changing the shape of an extrusion opening of each tube and the extrusion opening of the funnel-shaped spinneret. This method is effective in a modification of the shape of island portions, but does not allow a modification of the shape for obtaining the optical characteristic due to simple shape of the tubes.

In another known spinneret, a melt polymer for forming island portions is led to tubes through a distribution plate with a filter. A melt polymer for forming a sea portion is accumulated in a space between upper and lower plates through passages, and is led to the tubes through inlets for melt polymer. Subsequently, the melt polymer is extruded, without being mixed, to funnel-shaped portions of a spinneret plate through extrusion openings, and is ejected from discharge openings. This known spinneret can slightly modify the shape of island portions, however, it relates to a method of improving the drawing when using a fragile amorphous polymer to islands, and does not allow the shape of island portions with the optical dimension necessary to present the optical function.

On the other hand, today's society, which is considered as sensory society connected to near future intelligent society, has a big demand for high visual quality of consumer products. In the field of fibers, there is a demand for functional fibers which go further than an improvement in fabric properties as described above. The materialization of fibers is waited, having, e.g. impressive colors and reflection function of ultraviolet ray which prevents a degradation of fibers or that of infrared ray which is useful for hot insulation without carrying out any special treatment of fiber materials. This is not possible by the known method of forming modified cross-section fibers, particularly, by using the known spinneret.

Thus, for a forming of modified cross-section fibers, a design of a spinneret for controlling the shape of discharged polymer and a method of using same are very important factors. The form of a modified cross section of fibers should ensure a predetermined optical dimension for obtaining the above optical function. As being extremely complicated, such form of a modified cross section with optical dimension belongs in ultimate arts.

JP-A 6-017349(≠U.S. Pat. No. 5,407,738) discloses modified cross-section fibers having a laminated portion of dissimilar materials, and reflecting ultraviolet or infrared ray, or showing colors by reflection of visible light ray. As described in this document, parallel fin portions of a modified cross section and their peripheries serve to reflect ultraviolet or infrared ray or visible light ray due to optical dimension of a sea portion and an air layer, for example, to present a predetermined or desired optical function. It is, however, very difficult to form such modified cross-section fibers.

It is, therefore, an object of the present invention to provide a spinneret which can manufacture efficiently modified cross-section fibers with multioptical function.

SUMMARY OF THE INVENTION

According to one aspect of the present invention, there is provided a spinneret for manufacturing modified cross-section fibers with a first portion and a second portion surrounding the first portion out of melt polymers for forming the first and second portions, the spinneret comprising:

a spinning member serving to spin the first portion;

a plurality of tubes arranged to said spinning member, said plurality of tubes being for the melt polymer for forming the first portion; and a partition device mounted to said spinning member, said partition device serving to enclose said plurality of tubes, said spinning member and said partition device cooperating with each other to define a predetermined space.

Another aspect of the present invention lies in providing a spinneret for manufacturing modified cross-section fibers with a first portion and a second portion surrounding the first portion out of melt polymers for forming the first and second portions, the spinneret comprising:

means for spinning the first portion;

means for conveying the melt polymer for forming the first portion; and means for enclosing said conveying means, said spinning means and said enclosing means cooperating with each other to define a predetermined space.

BRIEF DESCRIPTION OF THE DRAWINGS

FIG. 6A is a fragmentary plan view showing the middle spinneret as viewed from below;

FIG. 6B is a fragmentary perspective view showing a partition device for controlling a passage for an island portion, which is disposed among an aggregate of tubes;

FIG. 7A is a cross section showing an example of a lamellar island portion of fibers;

FIG. 7B is a view similar to FIG. 7A, showing another example of the lamellar island portion of fibers;

DETAILED DESCRIPTION OF THE INVENTION

Figure 1:
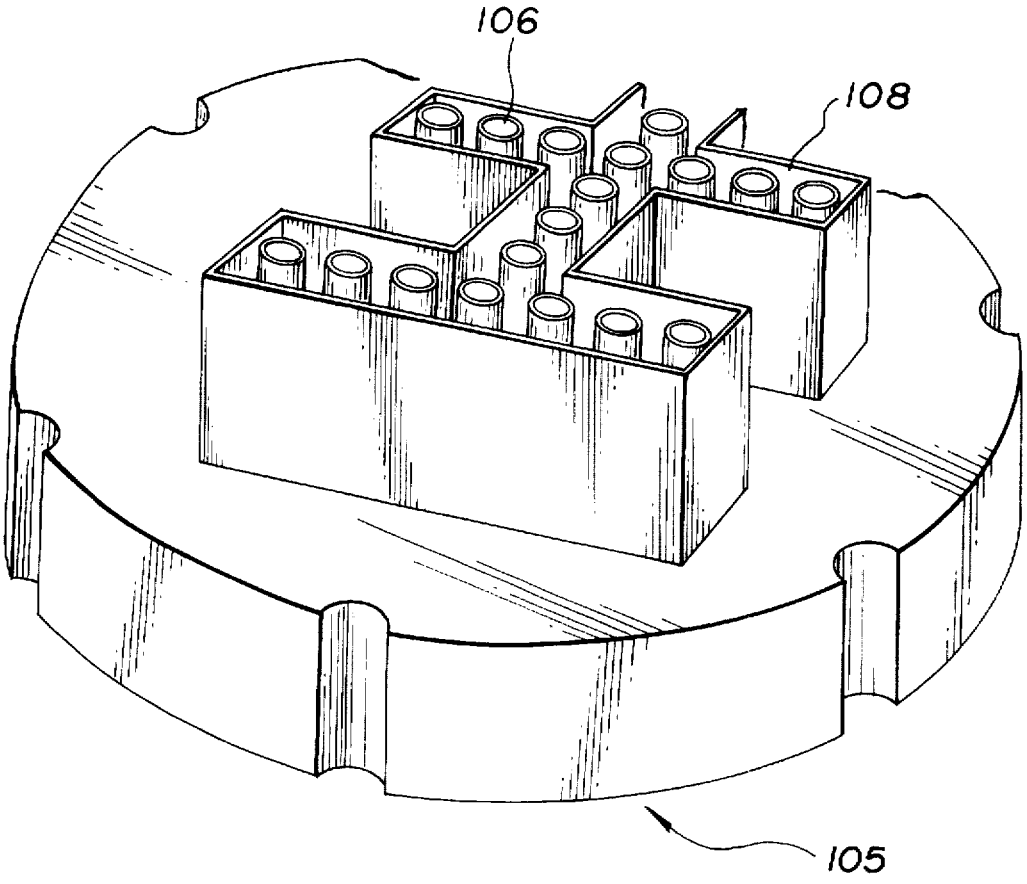
FIG. 1 is perspective view showing a preferred embodiment of a spinneret for manufacturing modified cross-section fibers with optical function according to the present invention.

Referring to the drawings, a description will be made with regard to preferred embodiments of a spinneret for manufacturing modified cross-section fibers with optical function.

Referring first to FIG. 1, a spinneret for manufacturing modified cross-section fibers with optical function will be described sketchily. This spinneret includes a spinneret for spinning an island portion or core member, which has a polymer extrusion side as shown in FIG. 1. It is noted that when forming modified cross-section fibers, passages of two melt polymers with different properties for forming island and sea portions are ensured separately up to a predetermined confluent point.

Examples of melt polymers to which the present invention is applicable are ordinary melt thermoplastic polymers including polyolefines such as polyethylene and polypropylene, polyesters such as poly(ethylene terephtalate) and poly (tetramethylene terephtalate), polystyrene, polycarbonate, poly(fluoroethylene), polyacetal, poly(phenylene sulfide), etc. Copolymers and mixed polymers having two or more of the above polymers can also be used at their melting temperature. For obtaining the optical function, an islands-in-a-sea structure should be formed out of two substances with a predetermined dimension, which correspond to two of the above materials, or one thereof and air which corresponds to a sea portion.

Referring to FIG. 1, for preventing melt polymers for forming an island portion from contacting each other, tubes 106 with a predetermined length are continuously embedded in a base of the spinneret for spinning an island portion as shown in FIG. 1 so that a small amount of the melt polymer flows downstream.

A partition device 108 for controlling a passage for an island portion is disposed among an aggregate of tubes 106 to obtain a predetermined modified cross section of fibers. Due to arrangement of the partition device 108, not only the melt polymer for forming an island portion is discharged only from the tubes 106 within the partition device 108, but flows out of the tubes 106 are joined within the partition device 108, improving the transcription of the shape of the island portion.

If a melt polymer for forming a sea portion is applied simultaneously, an islands-in-a-sea cross section is obtained, whereas if not, a modified cross section is obtained having only an island portion, a sea portion of which being an air layer. In the former case, if the height of the partition device 108, which is determined by the length of the tubes 106, is substantially identical to or slightly greater than the length of the tubes 106, a slight time lag is produced with regard to a contact of the melt polymer for forming an island portion with the melt polymer for forming a sea portion, improving the preservation or transcription of the shape of the island portion.

Figure 2:
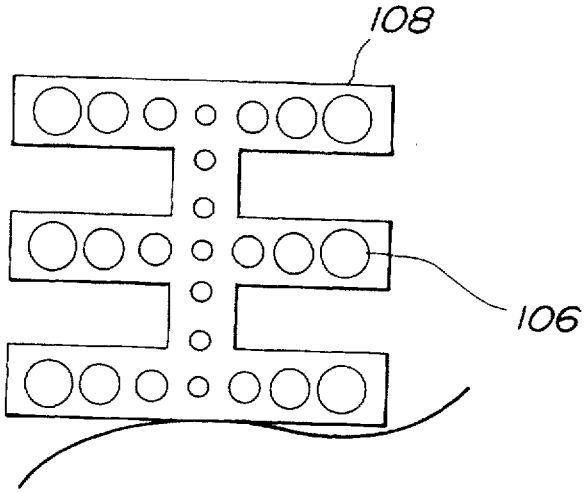
FIG. 2 is a diagrammatic view showing an example of arrangement of tubes of a spinneret for spinning an island portion.
Figure 3:
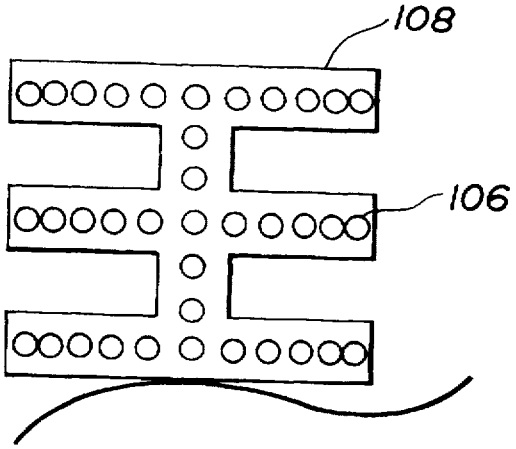
FIG. 3 is a view similar to FIG. 2, showing another example of arrangement of the tubes of the spinneret for spinning an island portion.

Generally, the inner diameter and center distance or pitch of the tubes 106 are the same in their entirety in view of manufacturing cost of the spinneret. However, when obtaining the shape of a modified cross section having parallel fin portions and a center portion perpendicular thereto, the melt polymer may be less supplied to ends of parallel slits of the partition device 108 for controlling a passage for an island portion than an intersection of the parallel slit and a center slit perpendicular thereto. Thus, for balancing a supply of the melt polymer to the intersection of the parallel and center slits with that one to the parallel slits, the inner diameter of the tubes 106 is gradually increased from the intersection of the parallel and center slits to the ends of the parallel slits as shown in FIG. 2, or the pitch of the tubes 106 is gradually decreased from the intersection of the parallel and center slits to the ends of the parallel slits as shown in FIG. 3.

For obtaining the optical function as disclosed in JP-A 6-017349(≠U.S. Pat. No. 5,407,738) which is incorporated herein for reference, the shape of a modified cross section is preferable to have parallel fin portions and a center portion perpendicular thereto. This document reveals that when 3Wa≦Wb (Wa :width of the center portion; Wb:length of the parallel fin portions), powerful optical function is obtained.

As described above, fibers should preserve a predetermined regular shape to present the optical function. Specifically, a separation of the parallel fin portions and a preservation of the shape thereof are very important factors in the process from a melt polymer to fibers.

In view of the foregoing, the spinneret of the present invention is designed to comprise the tubes 106 for extruding the melt polymer for forming an island portion or core member, and the partition device 108 for controlling a passage for an island portion so as to define a passage for the melt polymer for forming an island portion and a passage for the melt polymer for forming a sea portion which surrounds the island portion. Thus, with the shape substantially similar to the designed shape, the melt polymers are led to a spinning extrusion opening 107 (see FIG. 4).

The tubes 106 are easy to be machined when having the same length. On the other hand, referring to FIG. 4, in view of the fact that the length of the tubes 106 is dependent upon the shape of a funnel-shaped portion of a lower spinneret 102 for the melt polymers for forming sea and island portions, if the length of the tubes 106 is determined to have an extent approximately up to a position at which funnel-like inclinations start, the melt polymers for forming an island portion can not only be contacted with each other during a maximally lengthened period of time, but be affected minimally by a funnel-shaped wall of the lower spinneret 102 with respect to a compression. A greater effect is expected if the tubes 106 are gradually lengthened to a center of the aggregate of tubes 106, those placed at the outer periphery of the aggregate thereof having the above length.

Figure 4:
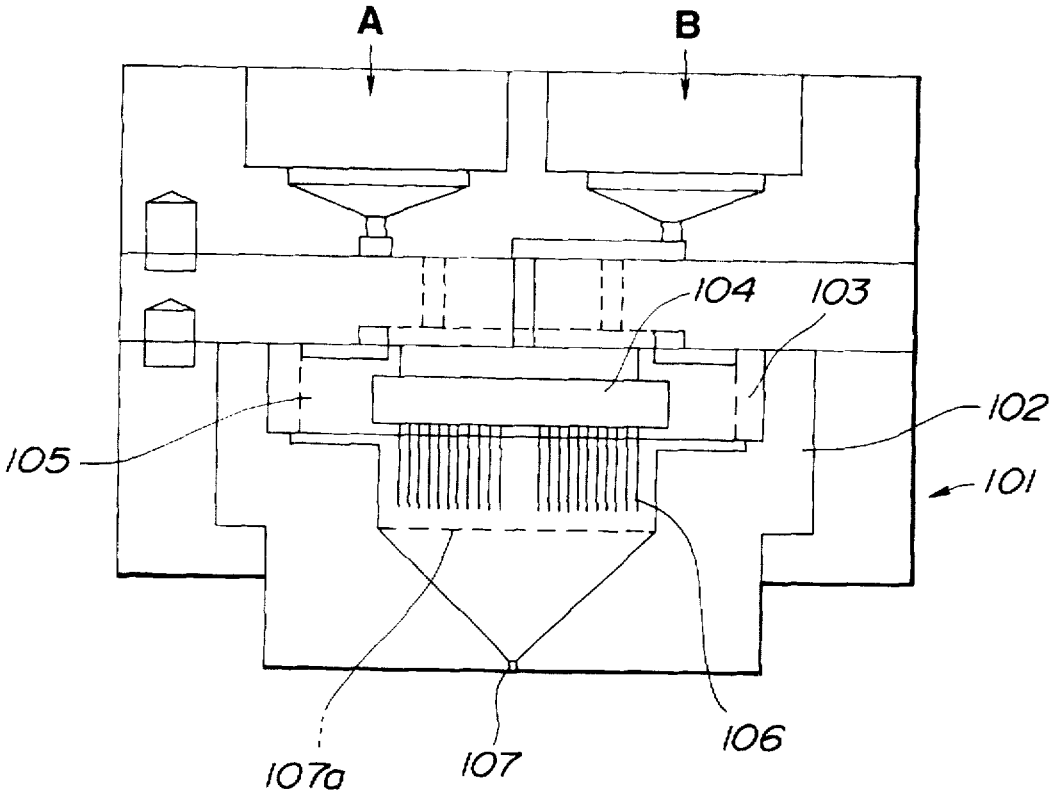
FIG. 4 is a schematic section showing a spinning equipment using the spinneret as shown in FIG. 1.

Referring always to FIG. 4, ordinarily, the shape of the spinning extrusion opening 107 is round. Alternatively, in view of the shape of the partition device 108 for controlling a passage for an island portion, e.g. if it has longitudinal and cross directions like a comb, the spinning extrusion opening 107 may be shaped in a strip which is narrow in the longitudinal direction of the partition device 108, and large in the cross direction thereof. With such consideration of a balance with respect to the compression and extrusion direction of the melt polymers, the modified shape of fibers can be preserved having a predetermined or desired aspect ratio, which is different from that of an opening defined by the partition device 108.

Referring to FIGS. 4–7B, a first embodiment of the present invention will be described. Referring particularly to FIG. 4, in a packaged head 101, a melt polymer A for forming a sea portion passes through passages 103 defined by a middle spinneret 105. A melt polymer B for forming an island portion passes through a passage 104 separated from the passages 103 and formed in the middle spinneret 105, and through the middle spinneret 105 integrated with the tubes 106. Then, the melt polymers A, B are extruded simultaneously to the lower spinneret 102 having the funnel-shaped portion, and are ejected from the spinning extrusion opening 107.

Figure 5A:
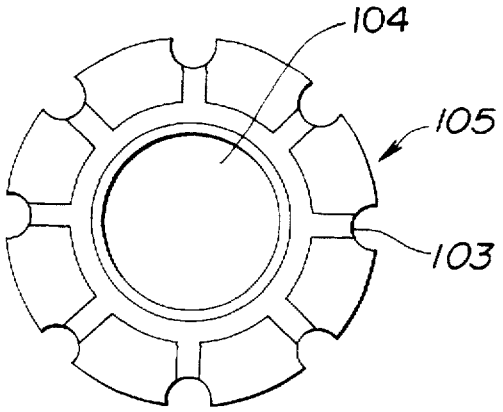
FIG. 5A is a plan view showing a middle spinneret.
Figure 5B:
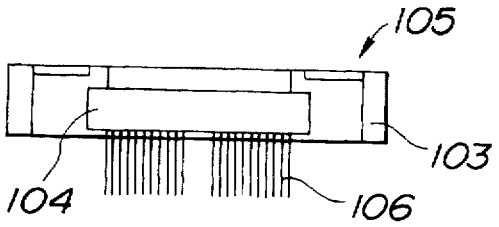
FIG. 5B is a sectional view showing the middle spinneret.
Figure 5C:
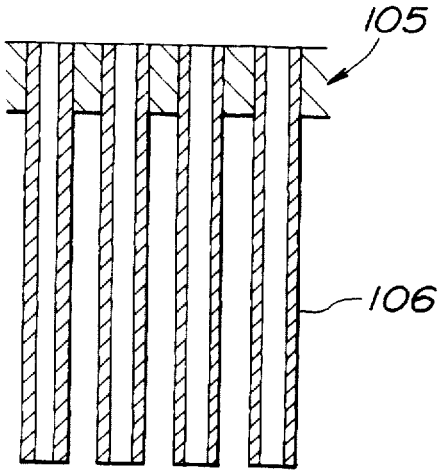
FIG. 5C is a view similar to FIG. 5B, showing an example of the tubes embedded in the middle spinneret.
Figure 5D:
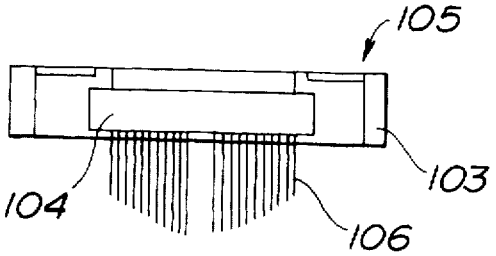
FIG. 5D is a view similar to FIG. 5C, showing another example of the tubes.

FIG. 5A shows an example of the middle spinneret 105 as a distribution plate of the melt polymer A. This example has the passages 103 as shown in FIG. 5A, which ensure an uniform flow of the melt polymer A to the tubes 106 with smaller pressure loss. FIG. 5C shows an example of a longitudinal section of the tubes 106 embedded in the middle spinneret 105. In the first embodiment, the inner diameter of the tubes 106 is 0.3 mm, and the center distance or pitch thereof is approximately 1.0 mm.

The tubes 106 are preferable to be as longer as possible, so that the length thereof is determined to have an extent approximately up to an upper level of the funnel-shaped portion as indicated by a dotted line 107*a* in FIG. 4, the nearest line at which the tubes 106 fail to contact with the melt polymer A for forming a sea portion. In the first embodiment, the length of the tubes 106 is 8 mm. Here, it is important, however, that the length of the tubes 106 is determined to minimize, particularly, a turbulence of an extrusion flow of the peripheral tubes 106. Moreover, referring to FIG. 5D, the tubes 106 may be gradually lengthened to the center of the aggregate of tubes 106.

FIG. 6A shows an example of the middle spinneret 105 with the tubes 106 embedded therein. FIG. 6B shows an example of the partition device 108 for controlling a passage for an island portion, which is disposed among the aggregate of tubes 106 as shown in FIG. 6A. In the first embodiment, the partition device 108 includes five parallel slits having the length gradually varied as shown in FIG. 6A, and the height equal to the length of the tubes 106+1 mm. Referring to FIG. 6A, the polymer is extruded only from the tubes 106 as indicated by white circles, those as indicated by black circles having a blinded inlet.

It will be thus understood that with the spinneret as shown in FIGS. 5A–5D and the partition device 108 for controlling a passage for an island portion as shown in FIG. 6B, modified cross-section fibers can be obtained with a plurality of optical dimensions.

Figure 9:
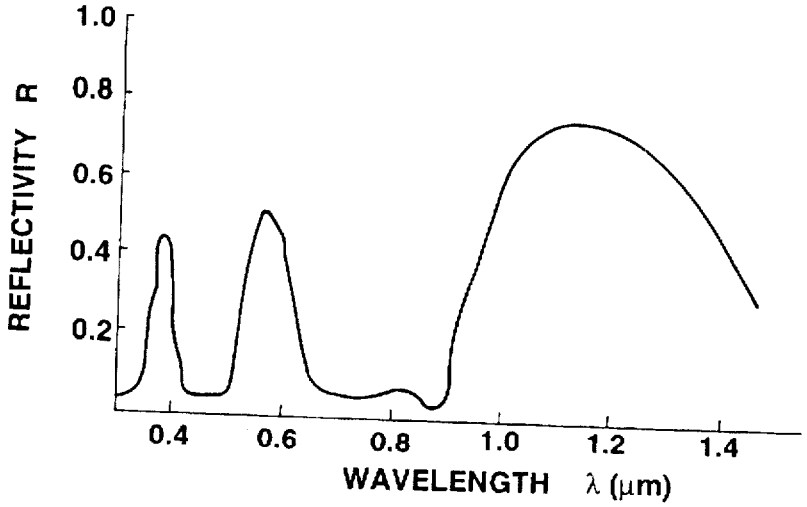
FIG. 9 is a graph illustrating the relation between the reflectivity and the wavelength for an island portion of fibers.

FIGS. 7A and 7B show a cross section of a lamellar island portion of fibers obtained by using polystyrene (PS) as the polymer for forming a sea portion, and polycarbonate (PC) as the polymer for forming an island portion, respectively. The island portion includes fin portions, or lamellas, extending out from a connecting portion (here shown as a central portion). The length of lamellas is the same in FIG. 7A, whereas the length thereof is varied in FIG. 7B. An optical measurement of the fibers as shown in FIGS. 7A and 7B reveals a light reflection function, i.e. a relation between the reflectivity and the wavelength, as shown in FIG. 9. As seen from FIG. 9, the lamellas and their peripheries can present a predetermined or desired optical function by reflecting ultraviolet or infrared ray or visible light ray for showing colors. For detailed information on the light reflection function as shown in FIG. 9, see JP-A 6-017349(≠U.S. Pat. No. 5,407,738). It will be understood that according to the first embodiment, the spinneret is provided which can manufacture efficiently modified cross-section fibers with multioptical function.

As described above, according to the first embodiment, the use of the partition device 108 for controlling a passage for an island portion contributes not only to an excellent preservation of the shape of fibers, by which the fibers can present a predetermined or desired optical function, but to an improvement in the quality and productivity of the fibers.

Referring to FIG. 2, a second embodiment of the present invention will be described. The second embodiment is substantially the same as the first embodiment except, particularly, the shape of the partition device 108 for controlling a passage for an island portion. Specifically, referring to FIG. 2, parallel slit defining portions of the partition device 108 have the same length, and the tubes 106 have an inner diameter gradually increased from the intersection of the parallel and center slits to the ends of the parallel slits, i.e. 0.65 mm at the intersection and 1.5 mm at the ends. According to the second embodiment, a lamellar cross section of an island portion of obtained fibers is transcribed in the degree equivalent or superior to that of FIGS. 7A and 7B. It will be understood that according to the second embodiment, also, the spinneret is provided which can manufacture efficiently modified cross-section fibers with multioptical function.

Figure 8A:
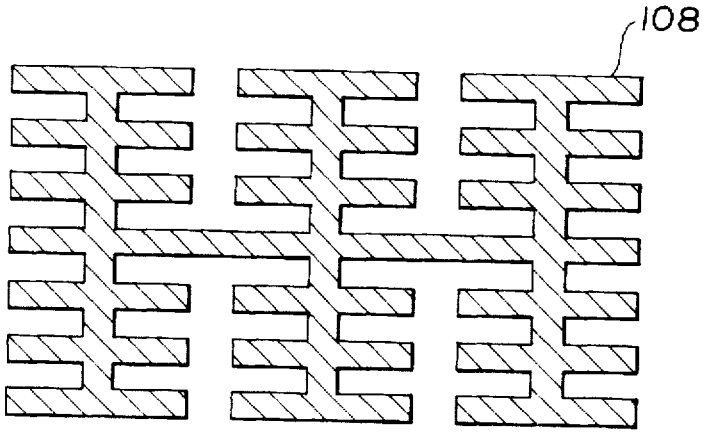
FIG. 8A is a cross section showing an example of the partition device for controlling a passage for an island portion.
Figure 8B:
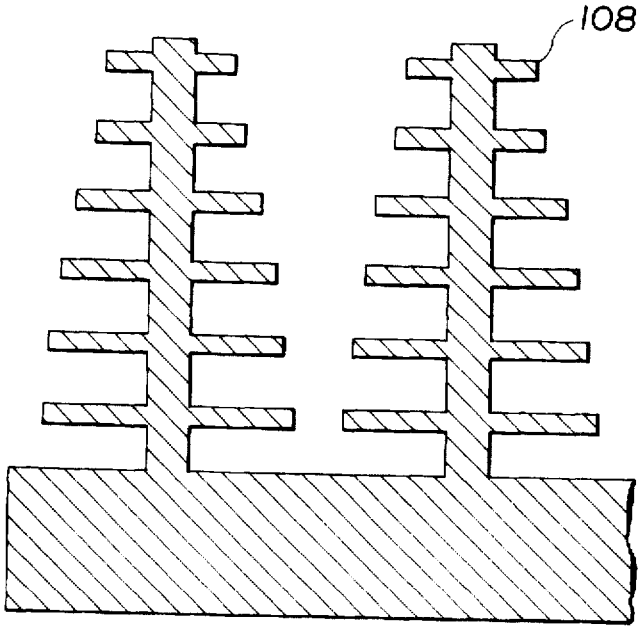
FIG. 8B is a view similar to FIG. 8A, showing another example of the partition device.

Referring to FIGS. 8A and 8B, a third embodiment of the present invention will be described. The third embodiment uses the same packaged head 101 as in the first and second embodiments, and the partition device 108 for controlling a passage for an island portion as shown in FIGS. 8A and 8B. Referring to FIG. 8A, the partition device 108 includes three groups of parallel slits with the same length, the middle parallel slits being connected to each other. Referring to FIG. 8B, the partition device 108 includes two groups of parallel slits with the different length, and a larger base slit through which a connection of the two groups of parallel slits are ensured. It is noted that the tubes 106 are placed on a portion with oblique lines in FIGS. 8A and 8B. With such partition devices 108, the transcription of a lamellar cross section of an island portion of obtained fibers is carried out excellently.

Having described the present invention in connection with the preferred embodiments, it is noted that the present invention is not limited thereto, and various changes and modifications can be made without departing from the spirit of the present invention.

What is claimed is:

1. A spinneret for manufacturing multicomponent fibers with a first portion and a second portion surrounding the first portion, the first portion and the second portion being formed out of a melt polymer, the spinneret comprising:

a spinning member serving to spin the first portion and the second portion;

a plurality of tubes arranged in said spinning member such that the melt polymer passes therethough for forming the first portion; and a partition device mounted to said spinning member, said partition device having both ends open and said partition device serving to enclose said plurality of tubes.

2. A spinneret as claimed in claim 1, wherein said partition device is formed to define an opening which in cross section comprises a first group of first slits arranged parallel to each other and a second slit arranged to intersect said first slits.

3. A spinneret as claimed in claim 2, wherein said first slits are of the same length.

4. A spinneret as claimed in claim 3, wherein said first slits are of different lengths.

5. A spinneret as claimed in claim 2, wherein said first group is connected to a second group of first slits by a connecting slit.

6. A spinneret as claimed in claim 5, wherein said connecting slit is placed in a middle of said first slits.

7. A spinneret as claimed in claim 5, wherein said connecting slit is wider than said first slits.

8. A spinneret as claimed in claim 7, wherein said connecting slit is placed at one end of said first slits.

9. A spinneret as claimed in claim 2, wherein said opening of said partition device is formed to satisfy a relation of $3Wa \leqq Wb$ wherein Wa is a width of said second slit and WB is a length of said first slits.

10. A spinneret as claimed in claim 9, wherein said partition device has a height equal to a length of adjacent ones of said plurality of tubes.

11. A spinneret as claimed in claim 9, wherein said partition device has a height greater than a length of adjacent ones of said plurality of tubes.

12. A spinneret as claimed in claim 11, wherein said plurality of tubes are of the same length.

13. A spinneret as claimed in claim 11, wherein each of said plurality of tubes has a length that gradually increases from a periphery of said spinning member to a center thereof.

14. A spinneret as claimed in claim 13, wherein each of said plurality of tubes has a diameter that gradually increases in a direction away from said second slit.

15. A spinneret as claimed in claim 13, wherein each of said plurality of tubes has a pitch that gradually decreases in a direction away from said second slit.

16. A spinneret for manufacturing an island portion of fibers having at least two fin portions separated by an air gap and a connecting portion for connecting the at least two fin portions, the island portion being formed out of a melt polymer, the spinneret comprising:

a spinning member serving to spin the island portion;

a plurality of tubes arranged in said spinning member such that the melt polymer passes therethrough to form the island portion; and a partition device mounted to said spinning member, said partition device having both ends open, said partition device serving to enclose said plurality of tubes.

17. A spinneret as claimed in claim 16, wherein said partition device is formed to define an opening which in cross section comprises a first group of first slits arranged parallel to each other and a second slit arranged to intersect said first slits.

* * * * *